US005814782A

United States Patent [19]

Müller et al.

[11] Patent Number: 5,814,782

[45] Date of Patent: Sep. 29, 1998

[54] ROWER CIRCUIT-BREAKER HAVING A CLOSING RESISTOR

[75] Inventors: Roger Müller, Sins; Jiri Talir, Buchs, both of Switzerland

[73] Assignee: Asea Brown Boveri AG, Baden, Switzerland

[21] Appl. No.: 746,936

[22] Filed: Nov. 18, 1996

[30] Foreign Application Priority Data

Dec. 16, 1995 [DE] Germany ..... 195 47 098.2

[51] Int. Cl.[6] ..... H01H 33/16; H01H 9/42

[52] U.S. Cl. ..... 218/143; 215/78; 215/84

[58] Field of Search ..... 218/57–67, 68–78, 218/82, 84, 143, 144

[56] References Cited

U.S. PATENT DOCUMENTS

| | | | |
|---|---|---|---|
| 3,763,340 | 10/1973 | Noack | 218/82 |
| 4,072,836 | 2/1978 | Bischofberger et al. | 218/143 |
| 4,338,500 | 7/1982 | Pham Van et al. | 218/143 |
| 4,421,962 | 12/1983 | Thuries et al. | 218/143 |
| 4,434,333 | 2/1984 | Kawasaki | 218/144 |
| 4,608,470 | 8/1986 | Bischofberger et al. | 218/143 |
| 4,636,599 | 1/1987 | Talir | 218/143 |
| 4,670,632 | 6/1987 | Bischofberger et al. | 218/143 |
| 4,973,806 | 11/1990 | Kirchesch et al. | 218/84 |

FOREIGN PATENT DOCUMENTS

| | | |
|---|---|---|
| 0152583B1 | 8/1985 | European Pat. Off. . |
| 0157922A1 | 10/1985 | European Pat. Off. . |
| 0313813B1 | 5/1989 | European Pat. Off. . |
| 2459861C2 | 8/1985 | Germany . |
| 3514184A1 | 10/1986 | Germany . |
| 4443184C1 | 2/1996 | Germany . |

OTHER PUBLICATIONS

"The closing resistor for $SF_6$ circuit–breakers from 170 kV up to 800 kV", Siemens AG publication, Sep. 1981.

*Primary Examiner*—J. R. Scott

*Attorney, Agent, or Firm*—Burns, Doane, Swecker & Mathis, L.L.P.

[57] ABSTRACT

The power circuit-breaker is provided with at least one arcing chamber which extends along a central axis and has at least one power interruption point with at least one contact which is moved by a drive. A closing resistor is connected in series with the power interruption point, having a resistive contact which is connected in parallel with the closing resistor and which closes after the power interruption point during the connection operation and opens after the power interruption point during the disconnection operation. This power circuit-breaker has a closing resistor and a resistive contact which has a simple and space-saving structure and which accurately timed actuation of the resistive contact is achieved. The resistive contact is mechanically connected to the at least one moving contact rectilinearly along at least one axis. Also, a coupling element is interposed in the rectilinear mechanical connection, and the coupling element is designed in such a way that it effects a time delay both during the connection operation and during the disconnection operation.

12 Claims, 2 Drawing Sheets

ROWER CIRCUIT-BREAKER HAVING A CLOSING RESISTOR

BACKGROUND OF THE INVENTION

1. Field of the Invention

The present invention generally relates to a power circuit-breaker and more specifically to a circuit breaker having a closing resistor.

2. Discussion of Background

Patent Specification EP 0 152 583 B1 describes a power circuit-breaker having a closing resistor which can be employed in a high-voltage power supply system. The power circuit-breaker has two series-connected arcing chambers and a closing resistor, which is constructed from two resistor elements. The closing resistor is bridged following connection by means of a resistive contact. The closing resistor is arranged in the center between the two arcing chambers. The resistive contact closes after the arcing chambers during connection and opens after the arcing chambers during disconnection. The resistive contact is actuated by a comparatively complicated drive mechanism.

U.S. Pat. No. 4,421,962 discloses another power circuit-breaker having a closing resistor. In the case of this power circuit-breaker, the closing resistor is connected into the circuit during connection by means of an auxiliary contact and is then subsequently bridged by the closing arcing chamber contacts.

SUMMARY OF THE INVENTION

Accordingly, one object of the invention is to provide a novel power circuit-breaker having a closing resistor and a resistive contact which has a simple and space-saving structure and to ensure that accurately timed actuation of the resistive contact is achieved using simple means.

The power circuit-breaker according to the invention can be employed in any installed position without any modifications. It is particularly suitable for outdoor circuit-breakers, but the arcing chamber, equipped with a closing resistor, of this power circuit-breaker can also very easily be installed in metal-enclosed gas-insulated switching installations.

The connection behavior of power circuit-breakers which are already operational can be decisively improved by retrofitting these power circuit-breakers with a closing resistor together with the associated resistive contact. Such retrofitting is possible with comparatively little outlay because only a small number of parts are required. In addition, it is very advantageous that the space required to enhance the power circuit-breaker in this way is very small, with the result that this enhancement does not require complicated structural alterations in the already existing switching installation.

BRIEF DESCRIPTION OF THE DRAWINGS

Other objects and advantages of the present invention will become more apparent from the following detailed description of the preferred embodiments when read in conjunction with the following figures wherein like elements have been represented by like numerals and wherein.

DESCRIPTION OF THE PREFERRED EMBODIMENTS

Figure 1:
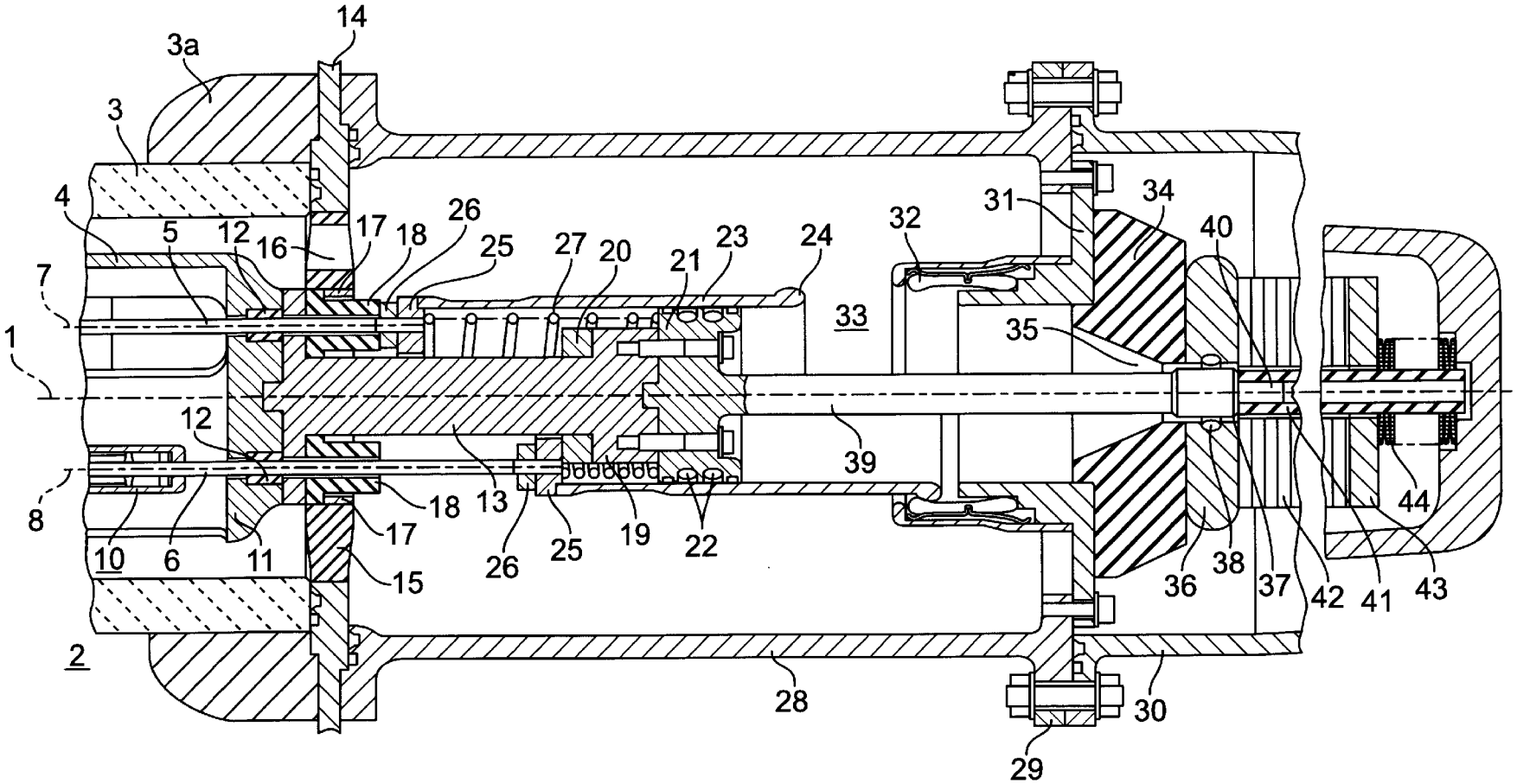
FIG. 1 shows a first partial section through a power circuit-breaker according to the invention, the top half of the drawing illustrating the disconnected state and the bottom half of the drawing illustrating the connected state.

As shown in FIG. 1, a power circuit-breaker has an arcing chamber 2 which has a cylindrical design, and extends along a central axis 1. An insulating housing 3, which closes off the arcing chamber volume from the outside, together with a metallic connecting flange 3*a* and a metal housing 4, which carries some exhaust gases, are also illustrated. The volume of the arcing chamber 2 is filled with an insulating gas, as a rule $SF_6$ gas. The arcing chamber 2 has a pair of erosion contacts. The erosion contacts of the arcing chamber 2 are both moved in this case, to be precise by means of a drive (not illustrated) in connection with two mutually diametrically opposed toothed racks, as is described, for example, in Patent Specification EP 0 313 813 B1. In the case of the power circuit-breaker according to the invention, these toothed racks are each mechanically coupled to an actuating rod 5 and 6 made of steel. The actuating rods 5 and 6 extend along the axes 7 and 8, respectively. The axes 7 and 8 likewise being mutually diametrically opposed and running parallel to and at the same distance from the central axis 1.

In the region of the metal housing 4, each of the actuating rods 5 and 6 is provided with an identically constructed coupling element 9 and 10, the structure of which will be described later. Only part of the coupling element 10 can be seen in FIG. 1, and the coupling elements 9 and 10 are illustrated completely in FIGS. 2 and 3. The metal housing 4 has an end flange 11, which has two holes each equipped with a plastic guidance part 12. The actuating rods 5 and 6 are each guided in the plastic guidance part 12. The end flange 11 is electrically conductively connected to a metallic carrier 13.

The housing 3 is connected in a pressure-tight manner to an intermediate flange 14 made of metal. The intermediate flange 14 is provided as a current connection on this side of the arcing chamber 2. A disk 15 made of an insulating material is incorporated in the intermediate flange 14. The disk 15 has continuous openings 16 which permit the $SF_6$ gas to flow through. The disk 15, which is connected on one side to the intermediate flange 14, is rigidly connected to the metallic carrier 13 on the other side by means of a flange-like holding ring 17.

The holding ring 17 additionally serves to secure two elastic buffers 18. The actuating rods 5 and 6 penetrate the end flange 11, an offset of the carrier 13 and the buffers 18. Worked on the carrier 13, on the end remote from the end flange 11, is a collar 19, whose shoulder, which faces the end flange 11, supports an elastic stop 20 of annular design. On the end facing away from the end flange 11, the carrier 13 is connected to a piston 21 which is of cylindrical design and in which, on its outer surface, helical contacts 22 and plastic guide rings assigned thereto are partially incorporated. A metallic contact cylinder 23 slides on the helical contacts 22 and the guide rings. On the contact cylinder's 23 end, remote from the end flange 11, rests a radially outwardly directed bead 24. The bead 24 may comprise, for example, silver-plated tungsten-copper. On the end facing the end flange 11, the contact cylinder 23 is provided with a cylinder base 25, into which the actuating rods 5 and 6 are screwed. These screwed connections are each secured by a lock nut 26. The lock nuts 26 interact with the buffers 18 during disconnection, while the cylinder base 25 impinges on the stop 20 during connection. A helical spring 27, which applies to the contact cylinder 23 a force in the direction toward the end flange 11, is located in the space between the contact cylinder 23 and the carrier 13.

The intermediate flange 14 is connected in a pressure-tight and an electrically conductive manner to a metallic housing 28, which concentrically surrounds the contact cylinder 23. A flange 29 is fitted on the end of the housing 28 which is remote from the intermediate flange 14. A closed, metallic resistor housing 30 is flanged in a pressure-tight and electrically conductive manner onto flange 29. In the interior of the housing 28, a contact carrier 31 is attached to the flange 29 and holds a cylindrical, basket-like arrangement of resiliently fastened contact fingers 32. The contact carrier 31 has through openings (not illustrated) which connect the volume inside the housing 28 to the volume enclosed by the resistor housing 30, which enables an exchange of the $SF_6$ gas to take place. The contact fingers 32 form with the contact cylinder 23 a releasable contact arrangement, which is designated as a resistive contact 33.

In the connected state of the resistive contact 33, the contact fingers 32 engage the bead 24 of the contact cylinder 23 and fix the contact cylinder 23 in its connection position by means of their spring force. The resistive contact 33 is designed in such a way that it can carry the entire rated current of the power circuit-breaker for an unlimited period of time. An insulation body 34 which has a central opening 35 is fastened on the side of the contact carrier 31 which is remote from the flange 29. The insulation body 34 bears a contact plate 36 which is made of metal and has a central hole 37. A helical contact 38 is incorporated in the wall of the central hole 37 and establishes electrical contact with the surface of a piston rod 39 which is integrally formed on the piston 21 and lengthens the piston rod in the axial direction. The piston rod 39 penetrates the contact carrier 31, the insulation body 34 and the contact plate 36. The piston rod 39 is lengthened in the axial direction beyond the contact plate 36 by a central guide pin 40.

The central guide pin 40 is surrounded by an insulating tube 41. A stack of cylindrical resistance bodies 42 having a central hole whose diameter is greater than the diameter of the insulating tube 41 is pushed onto the insulating tube 41. The resistance bodies 42 have an outer coating such that decomposition products of the $SF_6$ gas cannot attack their surface. A cylindrical, metallic thrust washer 43 having a central hole whose diameter is greater than the diameter of the insulating tube 41 is pushed onto the side of the stack of resistance bodies which is opposite to the contact plate 36. In addition, a stack of cup springs 44, through which the insulating tube 41 is guided and which is supported against the metallic resistor housing 30, is pushed onto the insulating tube 41. When the resistor housing 30 is screwed to the flange 29 in a pressure-tight manner, the cup springs 44 are tensioned in such a way that satisfactory current continuity from the contact plate 36 to the resistance bodies 42 and between these and from these via the thrust washer 43 and the cup springs 44 to the resistor housing 30 is ensured.

Figure 2:
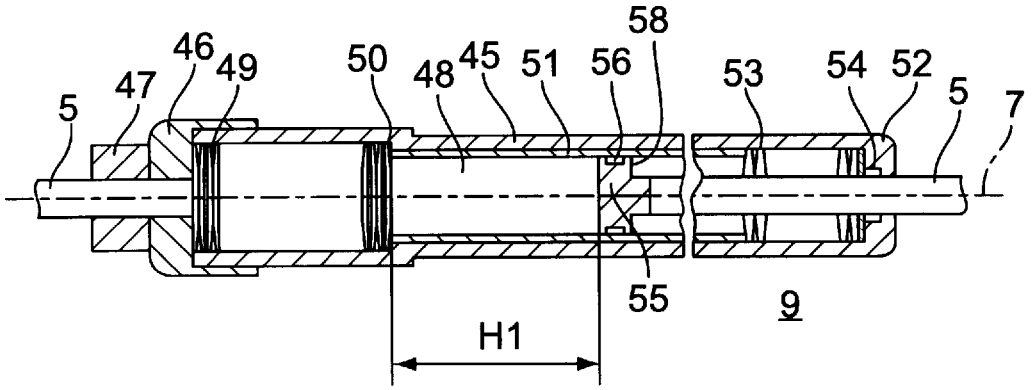
FIG. 2 shows a section through a first coupling element of the power circuit-breaker in the disconnected state.

FIG. 2 shows the coupling element 9, extending along the axis 7, with the arcing chamber 2 disconnected. The coupling element 9 has a cylindrical housing 45 which is made of an aluminum alloy and is closed off by an appropriate cover 46 on its left-hand end facing the erosion contacts of the arcing chamber 2. The actuating rod 5, which is connected directly to the upper toothed rack of the arcing chamber 2, is screwed into the center of the cover 46 and secured by means of a lock nut 47. The housing 45 has a central hole 48, which has a larger diameter at the end facing the cover 46. A cup spring assembly 49 is fitted in the region with the larger diameter and is supported against the cover 46 and a collar 50, lying opposite to the cover 46, in the central hole 48.

In the region with the smaller diameter, the central hole 48 is at least partially lined with a sliding sleeve 51, which is generally produced from a steel alloy. The sliding sleeve 51 is shorter than the region of the smaller diameter of the central hole 48. A second cup spring assembly 53 being positioned between the end of the sliding sleeve 51 which is remote from the cover 46 and the end part 52 of the housing 45 in the central hole 48. A central hole provided with a guide ring 54, which is produced, for example, from polytetrafluoroethylene, is placed in the end part 52. The actuating rod 5 emerging from the right-hand end of the housing 45 is guided by the guide ring 54. On its end facing the cover 46, the actuating rod 5 is provided with a piston 55, which has at least one piston ring 56. The piston ring 56 is produced, for example, from polytetrafluoroethylene, and can be displaced in the sliding sleeve 51. The piston 55 covers a travel Hl from the disconnection position to the connection position.

Figure 3:
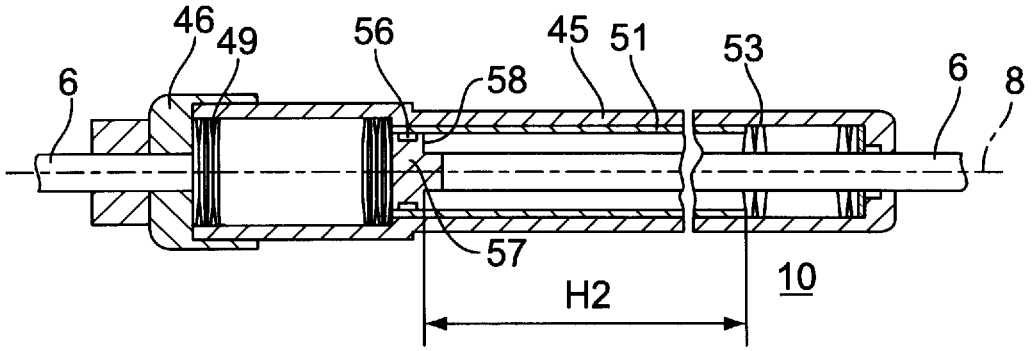
FIG. 3 shows a section through a second coupling element of the power circuit-breaker in the connected state.

FIG. 3 shows the coupling element 10, extending along the axis 8, with the arcing chamber 2 connected. The coupling element 10 has exactly the same structure as the coupling element 9. The actuating rod 6 is, in this case, screwed into the cover 46 on the side facing the erosion contacts of the arcing chamber 2. The continuation of the actuating rod 6, which emerges from the right-hand end of the housing 45, is integrally formed on the piston 57 moving in the sliding sleeve 51. As is illustrated in FIG. 3, the piston 57 touches the cup spring assembly 49 in the connection position of the arcing chamber 2. The piston 57 has a shoulder 58 on the side remote from the cup spring assembly 49.

The coupling element 9 interrupts the actuating rod 5, in such a way that the axis 7, along which the actuating rod 5 moves, is maintained for both parts of the actuating rod 5. However, during connection of both parts of the actuating rods, the movement of the contact cylinder 23 of the resistive contact 33 is delayed, because the axial movement transmitted from the toothed rack via the actuating rod 5 and the cover 46 to the housing 45 is transmitted to the piston 55. Thus, via the right-hand continuation of the actuating rod 5 to the contact cylinder 23, only after the housing 45 has covered the travel Hl.

The coupling element 10 interrupts the actuating rod 6, in such a way that the axis 8, along which the actuating rod 6 moves, is maintained for both parts of the actuating rod 6. However, during disconnection of the actuating rod 6, the movement of the contact cylinder 23 of the resistive contact 33 is delayed because the axial movement to the left transmitted from the toothed rack via the actuating rod 6 and the cover 46 to the housing 45 is transmitted to the piston 55. Thus, right-hand continuation of the actuating rod 5 to the contact cylinder 23 occurs only after the housing 45 has covered the travel H2. Accordingly, the movement of the contact cylinder 23 begins only after the cup spring assembly 53 has impinged on the shoulder 58 of the piston 55.

The two coupling elements 9 and 10, whose different action during connection and during disconnection described above, always operate in parallel with one another. As a result, tilting of the moving parts is avoided. Accordingly, the arcing chamber drive can advantageously be designed for a comparatively small drive energy, since comparatively little energy additionally has to be expended for the movement of the coupled resistive contact 33.

Figure 4:
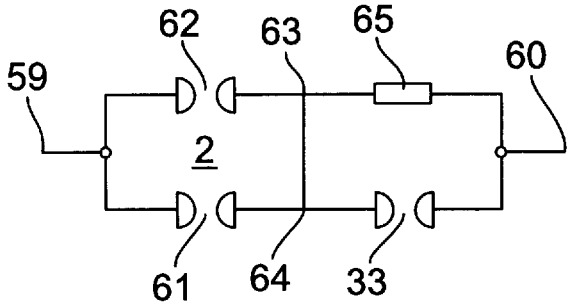
FIG. 4 shows a diagrammatic, electrical equivalent circuit diagram of a power circuit-breaker designed with an arcing chamber.

FIG. 4 shows a diagrammatic, electrical equivalent circuit diagram of the disconnected power circuit-breaker having a single arcing chamber 2. The power circuit-breaker has an input terminal 59 and an output terminal 60, between which the applied system voltage is present. The power circuit-breaker also has a power interruption point 61 and a rated current interruption point 62 in parallel with each other. The input terminal 59 is connected to a terminal 63 via the rated current interruption point 62 and to a terminal 64 via the power interruption point 61. The two terminals 63 and 64 are electrically conductively connected to one another. The terminal 63 is connected to the output terminal 60 via a closing resistor 65. The terminal 64 is connected to the output terminal 60 via the resistive contact 33. The closing resistor 65 is constructed from a multiplicity of resistance bodies 42. The end flange 11 is at the potential of the terminals 63 and 64. The connection from the terminal 63 to the output terminal 60 is embodied by the carrier 13, the piston 21, the piston rod 39, the helical contacts 38, the contact plate 36, the resistance bodies 42, the thrust washer 43, the cup springs 44, the resistor housing 30, the housing 28 and the intermediate flange 14. The connection from the terminal 64 via the closed resistive contact 33 to the output terminal 60 is embodied by the carrier 13, the piston 21, the helical contacts 22, the contact cylinder 23, the contact fingers 32, the contact carrier 31, the housing 28 and the intermediate flange 14.

In order to explain the method of operation, FIG. 4 will be considered more closely. During connection, the power interruption point 61 connects the circuit. To be precise, the current flows from the input terminal 59 via the power interruption point 61 and the closing resistor 65, connected in series therewith, to the output terminal 60. The rated current interruption point 62 then closes later. As long as the current is limited by the closing resistor 65, it is not possible for any undesirably high connection overvoltages, caused by the connection operation, to be formed in the power supply system. The closing resistor 65 must not remain in the circuit too long, or it would be thermally overloaded. Therefore, after a predetermined time delay, the resistive contact 33 short-circuits the closing resistor 65. In other words, the resistive contact 33 bridges the closing resistor 65 so that it is thermally relieved. The time delay required during connection is produced by the coupling elements 9 and 10. Different time delays can be set by altering the travel Hl and/or the characteristic of the cup springs of the cup spring assembly 49.

During disconnection, the rated current interruption point 62 opens first and the current commutates to the current path through the power interruption point 61. Only then does the power interruption point 61 open and the arc discharging there is subsequently quenched, thereby interrupting the circuit. At that time, with a time delay, the resistive contact 33 opens which concludes the disconnection operation. The time delay required during disconnection is produced by the coupling elements 9 and 10. It is possible to set different time delays by altering the travel H2.

As shown in FIGS. 1 and 2, during connection, the actuating rods 5 and 6, which are directly connected to the toothed racks are moved to the right together with the housings 45. The arcing chamber 2, which represents the rated current interruption point 62 and the power interruption point 61, closes during this movement, with the result that the closing resistor 65 is present in the circuit. The current now flows from the end flange 11 through the carrier 13, the piston 21, the piston rod 39, the helical contacts 38, the contact plate 36, the resistance bodies 42, the thrust washer 43, the cup springs 44, the resistor housing 30, the housing 28 and through the intermediate flange 14 out of the power circuit-breaker. As long as the two housings 45 have still not completely covered the travel Hl, the pistons 55 and 57 remain in the position shown in FIG. 2. Only when the two cup spring assemblies 49 impact against the pistons 55 and 57, (the impact being damped here by the cup spring assembly 49,) are the pistons 55 and 57 carried along. Likewise, the contact cylinder 23 which is connected to pistons 55 and 57 by the actuating rods 5 and 6, respectively, is moved towards the contact fingers 32.

As soon as a prestriking arc appears between the contact cylinder 23 and the contact fingers 32, the closing resistor 65 shown in FIG. 4 is bridged. The prestriking arc is quenched as soon as the contact cylinder 23 makes contact with the contact fingers 32. The contact fingers 32 are designed in such a way that they slide over the bead 24 of the contact cylinder 23 and hold the contact cylinder 23 in position in a positively locking manner. In the final connection position of the contact cylinder 23, the movement of the cylinder is braked by the elastic stop 20 on which the cylinder base 25 impinges. The helical spring 27 is prestressed during the connection movement of the contact cylinder 23. In the connection position, the current flows from the end flange 11 through the carrier 13, the piston 21, the helical contacts 22, the contact cylinder 23, the contact fingers 32, the contact carrier 31, the housing 28 and the intermediate flange 14 out of the power circuit-breaker. Merely insignificant stray currents, which do not thermally load the resistor, flow through the resistance bodies in this position of the power circuit-breaker.

Prior to disconnection, the pistons 55 and 57 are in the position illustrated in FIG. 3. During disconnection, the actuating rods 5 and 6 directly connected to the toothed racks are moved to the left together with the housings 45 respectively connected to them. The arcing chamber 2 opens during this movement. In other words the rated current interruption point 62 and the power interruption point 61 open. The contact cylinder 23 still remains in its connection position, held by the contact fingers 32. The force of the prestressed helical spring 27 is not able on its own to release the positive-locking connection between the contact fingers 32 and the contact cylinder 23. Even with a vertical structure, when the dead weight of the contact cylinder 23, in addition to the other forces, must be held by the contact fingers 32, this positive-locking connection is not automatically released. Only when the housings 45 have covered the travel H2, (at this point in time the disconnection arc discharging in the arcing chamber 2 has long since been quenched,) do the cup spring assemblies 53 impact against the shoulders 58 of the pistons 55 and 57 and carry along the pistons 55 and 57 connected to the contact cylinder 23. This impact is effectively damped by the cup spring assemblies 53. The contact cylinder 23 is drawn from the contact fingers 32. As soon as the contact fingers 32 have slid over the bead 24, the disconnection travel of the arcing chamber 2 is ended and the housings 45 of the coupling elements 9 and 10 do not move any further to the left. However, the contact cylinder 23 is moved by the force of the prestressed helical spring 27 further to the left in the direction toward the end flange 11, to be precise until the cylinder base 25 or the two lock nuts 26 impinge on the two elastic buffers 18. The buffers 18 limit the travel of the contact cylinder 23 in its disconnection position. The pistons 55 and 57 are then in the position shown in FIG. 2, the disconnection operation is concluded and the coupling elements 9 and 10 are once again ready for the next connection operation.

The exemplary embodiment described in detail here shows an arcing chamber 2 having two erosion contacts which are moved in opposite directions. However, it is also possible to equip arcing chambers having just one moved erosion contact with closing resistors, the electrical equivalent circuit diagram shown in FIG. 4 being applicable in this case, too. However, with this type of power circuit-breaker, the actuating rods 5 and 6 must, if appropriate, be at least partially produced from an insulating material, this being the case particularly when the end flange 11 is connected to the fixed erosion contact, with the result that the entire quenching path of the arcing chamber 2 must be spanned by the actuating rods 5 and 6. In this case, the actuating rods 5 and 6 must be produced from the temperature-resistant insulating material at least in the region of the quenching path.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A power circuit breaker, comprising;

at least one arcing chamber extending along a central axis having at least one power interruption point with at least one contact which is moved by a driving mechanism, said at least one arcing chamber having at least one closing resistor which is connected in series with the at least one power interruption point, and said at least one arcing chamber having a resistive contact which is connected in parallel with the at least one closing resistor and which closes after the at least one power interruption point during the connection operation and opens after the at least one power interruption point during the disconnection operation, wherein the resistive contact is mechanically connected to the at least one moving contact, rectilinearly along at least one axis and a coupling element is interposed in the rectilinear mechanical connection, and the coupling element is operable to effect a time delay both during the connection operation and the disconnection operation.

2. The power circuit breaker as claimed in claim 1, wherein the coupling element has a different delay time during both the connection operation and disconnection operation.

3. The power circuit breaker as claimed in claim 1, wherein a double connection is provided between the at least one moving contact and the resistive contact, and each connection of said double connection extends along a respective axis, and each respective axis runs opposite one another and parallel and are equidistant from the central axis of the at least one arcing chamber.

4. The power circuit breaker as claimed in claim 1, wherein the at least one power interruption point has two contacts which move in opposite directions.

5. The power circuit breaker as claimed in claim 4, wherein the resistive contact is connected to the movable contact, which is directly connected to the drive of the at least one arcing member.

6. The power circuit breaker as claimed in claim 1, wherein the coupling element has a housing with a central hole which is closed at one end by a cover, wherein cup spring assemblies are inserted into the central hole at each of the ends of said coupling element, and a sliding sleeve is inserted between said cup spring assemblies, an actuating rod is fastened in the cover, and a piston is arranged so that it can be displaced in the sliding sleeve, an actuating rod which is integrally formed on the piston, emerges from said housing at the end opposite to said cover.

7. A power circuit-breaker, comprising;

at least one arcing chamber extending along a central axis having at least one power interruption point with at least one moveable contact which is moved by a driving mechanism, said at least one arcing chamber having at least one closing resistor which is connected in series with the at least one power interruption point, and said at least one arcing chamber having a resistive contact which is connected in parallel with said closing resistor and which is operable to close after the at least one power interruption point during a connection operation and to open after the at least one power interruption point during a disconnection operation, the resistive contact being in a rectilinear mechanical connection with the at least one moveable contact, wherein the resistive contact is interposed rectilinearly along at least one axis; and a coupling element placed in the rectilinear mechanical connection, the coupling element being operable to effect a time delay during the connection operation and the disconnection operation.

8. The power circuit breaker as claimed in claim 7, wherein said coupling element has different delay times during the connection operation and disconnection operation.

9. The power circuit breaker as claimed in claim 7, further comprising:

a double connection between said at least one moveable contact and the resistive contact, each of two connections of said double connection extending along a respective axis, said respective axes being opposite one another, parallel and equidistant from the central axis of the arcing chamber.

10. The power circuit breaker as claimed in claim 7, wherein the at least one power interruption point has two contacts which move in opposite directions.

11. The power circuit breaker as claimed in claim 10, wherein said resistive contact is connected to the moveable contact, said moveable contact being directly connected to the drive of the at least one arcing member.

12. The power circuit breaker as claimed in claim 7, further comprising:

a housing of said coupling element being formed with a central hole which is closed at one end by a cover, a cup spring assembly inserted into said central hole at opposite ends thereof, and a sliding sleeve inserted into said centered hole at a location between said cup spring assemblies;

an actuating rod fastened in the cover; and a piston displaceably arranged in the sliding sleeve, said piston having said actuating rod integrally formed thereon and emerging from said housing at an end opposite said cover.

* * * * *